United States Patent [19]

DeMascolo

[11] 4,222,569

[45] Sep. 16, 1980

[54] BENT WRIST SIGNAL DEVICE

[76] Inventor: Guy J. DeMascolo, 1500 Bay Rd., Miami Beach, Fla. 33139

[21] Appl. No.: 947,595

[22] Filed: Oct. 2, 1978

[51] Int. Cl.[3] ..... A63B 69/36

[52] U.S. Cl. ..... 273/183 B; 273/54 B

[58] Field of Search ..... 273/189 R, 189 A, 183 B, 273/54 B; 116/67 R; 2/161 A

[56] References Cited

U.S. PATENT DOCUMENTS

| | | | |
|---|---|---|---|
| 2,064,603 | 12/1936 | Harrison | 273/183 B X |
| 2,809,042 | 10/1957 | Wasley | 116/67 R X |
| 2,831,196 | 4/1958 | Scheiber | 273/189 R |
| 3,533,407 | 10/1970 | Smith | 273/189 A |

*Primary Examiner*—George J. Marlo

[57] ABSTRACT

A wrist signal means in the form of a wrist wrap to encircle the wrist of a user and in which there is a pocket extending across the back of the hand and the forearm at the wrist juncture so that, when the wrist is moved in flexion or extension, a flat generally rectangular metal plate in the pocket is flexed or bent causing a noise to be emitted to signal that the wrist has been moved. The device may include a tightener strap to tighten the noise-making plate against the wrist.

6 Claims, 7 Drawing Figures

BENT WRIST SIGNAL DEVICE

FIELD OF THE INVENTION

This invention relates to a wrist signal means and more particularly to a wrist wrap wherein there is included in a pocket within the wrist wrap a noise-making device which extends over part of the forearm and part of the back of the hand so that when the wrist is moved in flexion and extension a noise signal will be emitted.

BACKGROUND OF THE INVENTION

In many sports, such as golf and bowling, one is encouraged to play according to certain body form in which the wrist is straight, that is the back of the hand is generally coplanar with the back of the forearm. Then, at a certain position, the wrist is flexed to give a snapping or power action. It is for this reason that it is often desired to have some type of indicator means to indicate when the wrist has moved into a position from another position, as at the top of a golf swing, or when bowling, when the ball has been raised to its maximum height behind a player just prior to the pendulum swing of release of the ball. This invention is of such a wrist signal means.

OBJECTS OF THE INVENTION

It is an object of this invention to provide a wrist wrap for the hand of a user, which may include finger sockets and thumb sockets as in a glove, but which in any case includes a pocket arranged to overlay the back of the hand and the forearm adjacent the wrist and within which a sound-making sheet to be clicked when flexed is situated. The device may have as a further object the provision of a detector to detect sensitivity and signal when the wrist flexes and which is adjustable and which may be in the form of a Velcro strap and pads to tighten the noise-making sheet of metallic material against the surface of the back of the hand and forearm.

In accordance with these and other objects which will become apparent hereinafter, the instant invention will now be described with reference to the accompanying drawings in which:

DESCRIPTION OF THE PREFERRED EMBODIMENT

Figure 1:
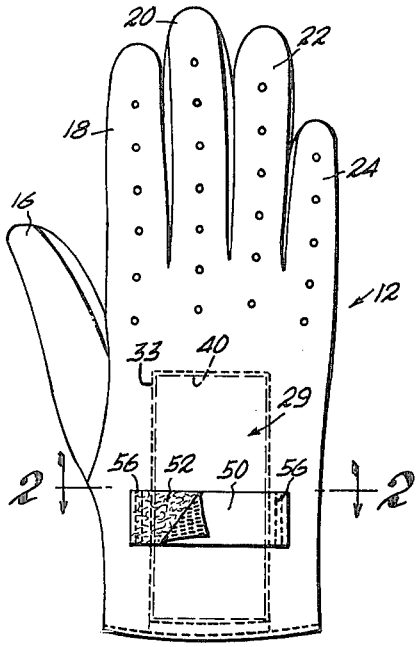
FIG. 1 is an elevation view illustrating the instant invention.
Figure 2:
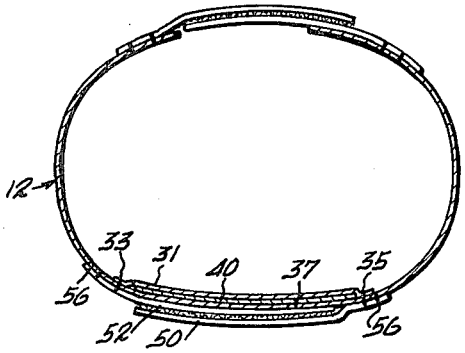
FIG. 2 is a view in cross section taken on the plane indicated by the line 2—2 of FIG. 1 and looking in the direction of the arrows.
Figure 3:
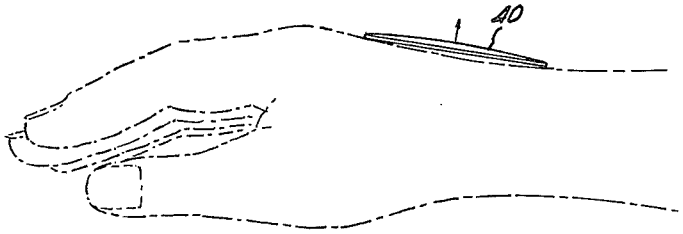
FIGS. 3 and 4 are schematic views illustrating the operation of the instant invention.
Figure 4:
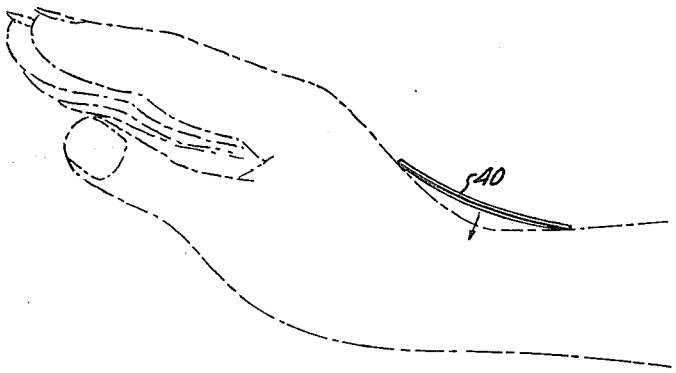

Referring to the drawings and in particular to FIG. 1, there is shown a glove generally designated by the numeral 12 which includes a portion 14 which normally is in surrounding relation of the wrist. The glove shown has sockets for the thumb and fingers which are generally designated by the numerals 16, 18, 20, 22 and 24. In that zone which overlays the wrist, there is a pocket zone designated by the numeral 29 which may be defined by a panel 31 stitched as at 33 and 35 to the glove panel 37. Within this pocket a noise-making device is provided which is in the form of a clicker or rectangular sheet of metallic material which when bowed causes a sound to be emitted. The clicker is designated by the numeral 40; and it is received within the pocket. In use, it overlays the wrist as shown in FIGS. 3 and 4. A Velcro fastener means may be utilized to hold the clicker in place. The Velcro fastener is in the form of a strip 50 with J-hooks arranged to engage the loops of nap such as 52, both the nap and J-hooks being secured by stitching such as 56 in FIG. 2, to the panel.

It is thus seen that there is provided a wrist signal means generally which detects up and down movement in flexion and extension of a user's wrist. The wrist signal means includes a wrist wrap or holding member to support the wrist signal means or clicker over the widest portion of the wrist of a user. The sound making article 40 which is preferably rectangular and bowed is adapted to make an audible sound when it is bent to provide a basis for emission of sound upon flexing of the wrist of a user. It is further seen that a generally flat sound making article holding pocket is connected onto the wrist holding member to hold the sound making article against the user's wrist to provide sound from the sound making article when the user moves his wrist in flexion and extension beyond the normal condition of the sound making article or panel, which is ordinarily of thin metal. The sound making article held in the pocket makes the sound which is responsive to, and sensitive to, flexion and extension of the user's wrist to product the signal upon movement of it. The holding member may include securing straps of Velcro to be connected to tighten the sound making article in the wrist holding pocket to vary the sensitivity of the sound making article. The straps positioned about the wrist area and comprising the Velcro mating strips 50 and 52 tighten the sound making article over the wrist to meet a user's desired sensitivity as he improves his game using the device to alert him when there has been a movement which is not desired. It will be seen that in the preferred embodiment the sound making device is a flat metal conventional noise-maker.

Figure 5:
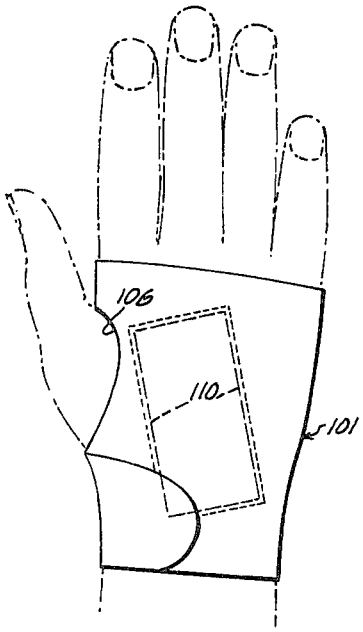
FIG. 5 is an elevation view of an alternative embodiment of the instant invention.
Figure 6:
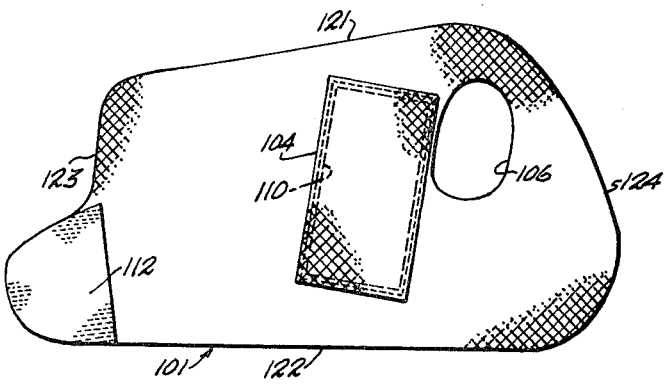
FIG. 6 is an inside view of the device shown in FIG. 5.
Figure 7:
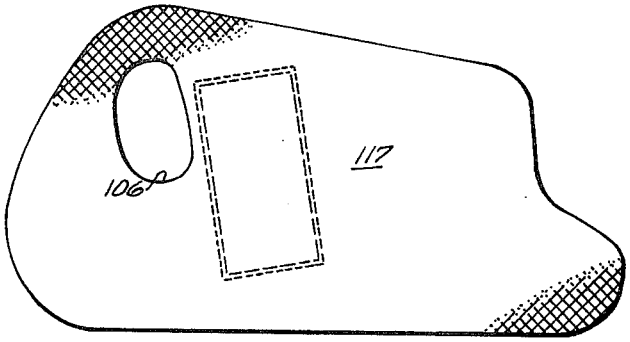
FIG. 7 is an outside view of the device shown in FIG. 7.

Referring to FIGS. 5, 6 and 7 which show an alternative embodiment, this may be utilized by a bowler for example. The device consists of a wrist wrap 101 within which there is a pocket structure 104 adjacent a thumb hole 106 and within which there is arranged the noice-making piece 110. A Velcro J-hook pad means such as 112 may be provided to interengage with any selected portion of the exterior shown in FIG. 7 which is preferably of nap 117. It will be seen that the wrist wrap is sized to cover the broadest part of the wrist substantially beyond the crotch or breaking point between the hand and the forearm, as shown in FIG. 4, for example, when the wrist is moved as in flexion and extension of a user's wrist. In this embodiment, the edge 121 is not perfectly parallel to the edge 122 but, rather, diverges from the Velcro pad side 123 toward the thumb side 124, the latter being curved as shown for the purposes of conforming to the hand in use.

What is claimed is:

1. A wrist signal means for detecting up and down movement in flexion and extension of a user's wrist comprising:

a wrist wrap for a user's hand having a back portion and a front hand portion, the wrist wrap generally defining a glove, and a pocket zone located at the back of the wrist wrap and positioned thereupon such that the pocket zone is substantially beyond the crotch or breaking point between the hand and forearm at the widest portion of the user's hand, a wrist movement sensor including, a generally flat sound-making article defining a clicker which makes an audible sound emission upon being bent to provide a basis for sound emission upon wrist movement, the clicker in and secured to the pocket zone sensitive to flexion and extension of the user's wrist whereupon an audible signal upon wrist movement is produced, means for captivating the clicker within the pocket zone defining straps with connecting means, the straps also comprising means for varying the sensitivity of the clicker to wrist movement, the straps extending from one side of the pocket zone to the other over the pocket zone and thereby over the clicker, and whereby pressure may be varied on the wrist movement sensor without interferring with the movement of the wrist of the user since the straps do not extend and encircle the wrist.

2. The device as set forth in claim 1 wherein the wrist wrap includes finger and thumb sockets.

3. The device as set forth in claim 1 or 2 wherein the pocket zone is rectangular and the clicker comprises a slightly bowed, rectangular, metal sound-making device sized and shaped to fit in the rectangular pocket zone.

4. A wrist signal means for detecting up and down movement as set forth in claim 1 or 2 wherein said wrist wrap is a glove, and said sound-making article is generally a flat metal noise maker.

5. The device as set forth in claim 4 wherein said wrist wrap comprises a band and means to hold the band in encircling relation of the wrist of a user.

6. A wrist signal means for detecting movement as set forth in claim 4 or 2 wherein, said pocket zone includes a pocket for holding said sound-making article.

* * * * *